US009888734B2

(12) United States Patent
Bevier et al.

(10) Patent No.: US 9,888,734 B2
(45) Date of Patent: Feb. 13, 2018

(54) ENERGY ABSORBING ATHLETIC GLOVE

(71) Applicant: NIKE, Inc., Beaverton, OR (US)

(72) Inventors: Joseph J. Bevier, Portland, OR (US); Michael S. Amos, Beaverton, OR (US); Mark McNamee, Portland, OR (US); Sam Fisher, Portland, OR (US); Christopher R. Kvamme, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 249 days.

(21) Appl. No.: 14/714,961

(22) Filed: May 18, 2015

(65) Prior Publication Data

US 2015/0272242 A1 Oct. 1, 2015

Related U.S. Application Data

(63) Continuation of application No. 12/834,276, filed on Jul. 12, 2010, now Pat. No. 9,032,553.

(51) Int. Cl.

| | |
|---|---|
| ***A41D 19/015*** | (2006.01) |
| ***A63B 71/14*** | (2006.01) |
| ***A41D 19/00*** | (2006.01) |

(52) U.S. Cl.

CPC ... *A41D 19/01558* (2013.01); *A41D 19/0006* (2013.01); *A41D 19/01523* (2013.01); *A63B 71/141* (2013.01); *A63B 2243/0025* (2013.01)

(58) Field of Classification Search

CPC ..... A41D 19/01523; A41D 19/01558; A41D 19/00006; A63B 71/141; A63B 71/148; A63B 19/01558

See application file for complete search history.

(56) References Cited

U.S. PATENT DOCUMENTS

| | | | |
|---|---|---|---|
| 5,036,551 | A | 8/1991 | Dailey et al. |
| 5,404,591 | A | 4/1995 | Brinnand et al. |
| 5,598,582 | A | 2/1997 | Andrews |
| 5,648,003 | A | 7/1997 | Liang et al. |

(Continued)

OTHER PUBLICATIONS

Non-Final Office Action dated Apr. 9, 2014 in U.S. Appl. No. 12/834,276, 8 pages.

(Continued)

*Primary Examiner* — Danny Worrell

(74) *Attorney, Agent, or Firm* — Shook, Hardy and Bacon, L.L.P.

(57) ABSTRACT

An energy absorbing receiving glove constructed with a substrate having an exterior surface and a complementary interior surface. The substrate is used in constructing a palmar portion of the glove. The glove may incorporates a gripping layer of material affixed to the exterior surface of the substrate. Further, the glove may incorporate an energy absorbing layer of material affixed to the interior surface of the substrate. Additionally, the energy absorbing layer of material may have both a first thickness in a first location and a second thickness in a second location of the substrate. In an embodiment, the energy absorbing material is a silicone gel and the gripping material is a silicone material. Additionally, the varied thicknesses of the energy absorbing material may be effective for covering a palmar side of joints located on a hand wearing the glove.

20 Claims, 6 Drawing Sheets

(56) References Cited

U.S. PATENT DOCUMENTS

| | | | | |
|---|---|---|---|---|
| 5,682,613 | A * | 11/1997 | Dinatale | A41D 19/0006 2/161.5 |
| 5,926,847 | A | 7/1999 | Elbert | |
| 5,991,926 | A | 11/1999 | Lakusiewicz | |
| 6,004,662 | A | 12/1999 | Buckley | |
| 6,618,860 | B1 | 9/2003 | Sullivan et al. | |
| 7,140,046 | B2 | 11/2006 | Ono et al. | |
| 7,171,697 | B2 | 2/2007 | Vito et al. | |
| 7,669,251 | B2 | 3/2010 | Hammons et al. | |
| 8,104,098 | B1 * | 1/2012 | Kleinert | A41D 19/01523 2/159 |
| 8,132,269 | B1 | 3/2012 | Ibon et al. | |
| 8,256,028 | B1 | 9/2012 | Ibon et al. | |
| 8,312,562 | B2 | 11/2012 | Hammons et al. | |
| 9,572,383 | B2 * | 2/2017 | Kleinert | A41D 13/081 |
| 2006/0206977 | A1 | 9/2006 | Hammons et al. | |
| 2012/0159681 | A1 | 6/2012 | Gibby | |

OTHER PUBLICATIONS

Final Office Action dated Nov. 6, 2014 in U.S. Appl. No. 12/834,276, 9 pages.
Notice of Allowance dated Jan. 21, 2015 in U.S. Appl. No. 12/834,276, 5 pages.

* cited by examiner

ENERGY ABSORBING ATHLETIC GLOVE

CROSS-REFERNCE TO RELATED APPLICATIONS

This application is a Continuation Application of U.S. application Ser. No. 12/834,276, filed Jul. 12, 2010 and entitled "Energy Absorbing Athletic Glove" the entirety of which is incorporated herein by reference.

BACKGROUND

Athletic competitions may be won and lost based on a single event. Consequently, an athlete participating in a competition strives to perform his or her very best at each opportunity. Some sport activities include catching an object with the athlete's hand(s). For example, an American football receiver catches a football with one or both hands. The athlete may look to increase the success of catching the object by enhancing and supplementing natural characteristics of the very hand(s) catching the object.

Natural characteristics of a hand include a coefficient of friction that exists between the hand and the object. Another natural characteristic includes energy absorption materials naturally occurring within the hand. For example, fat, muscle, and fluids may serve as a natural energy absorbing material at locations of the hand. However, not all areas of a hand have a desired coefficient of friction and/or quantity of naturally occurring energy absorption material.

Therefore, in an effort to increase an athlete's chance at succeeding, some athletes may desire to supplement natural characteristics with gear. For example, a baseball catcher may wear a leather mitt designed for securing a pitch from a pitcher. Similarly, an athlete whose responsibilities may include catching, receiving, or otherwise securing an object may also desire to supplement natural characteristics of their hand(s) by wearing one or more gloves.

SUMMARY

Embodiments of the present invention relate to a glove. The glove includes a substrate having an exterior surface and a complementary interior surface. The substrate is used in constructing a palmar portion of the glove. The glove incorporates a first layer of material affixed to the exterior surface of the substrate. Further, the glove incorporates a second layer of material affixed to the interior surface of the substrate. Additionally, one of the first layer or the second layer of material has both a first thickness in a first location and a second thickness in a second location along a surface of the substrate.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
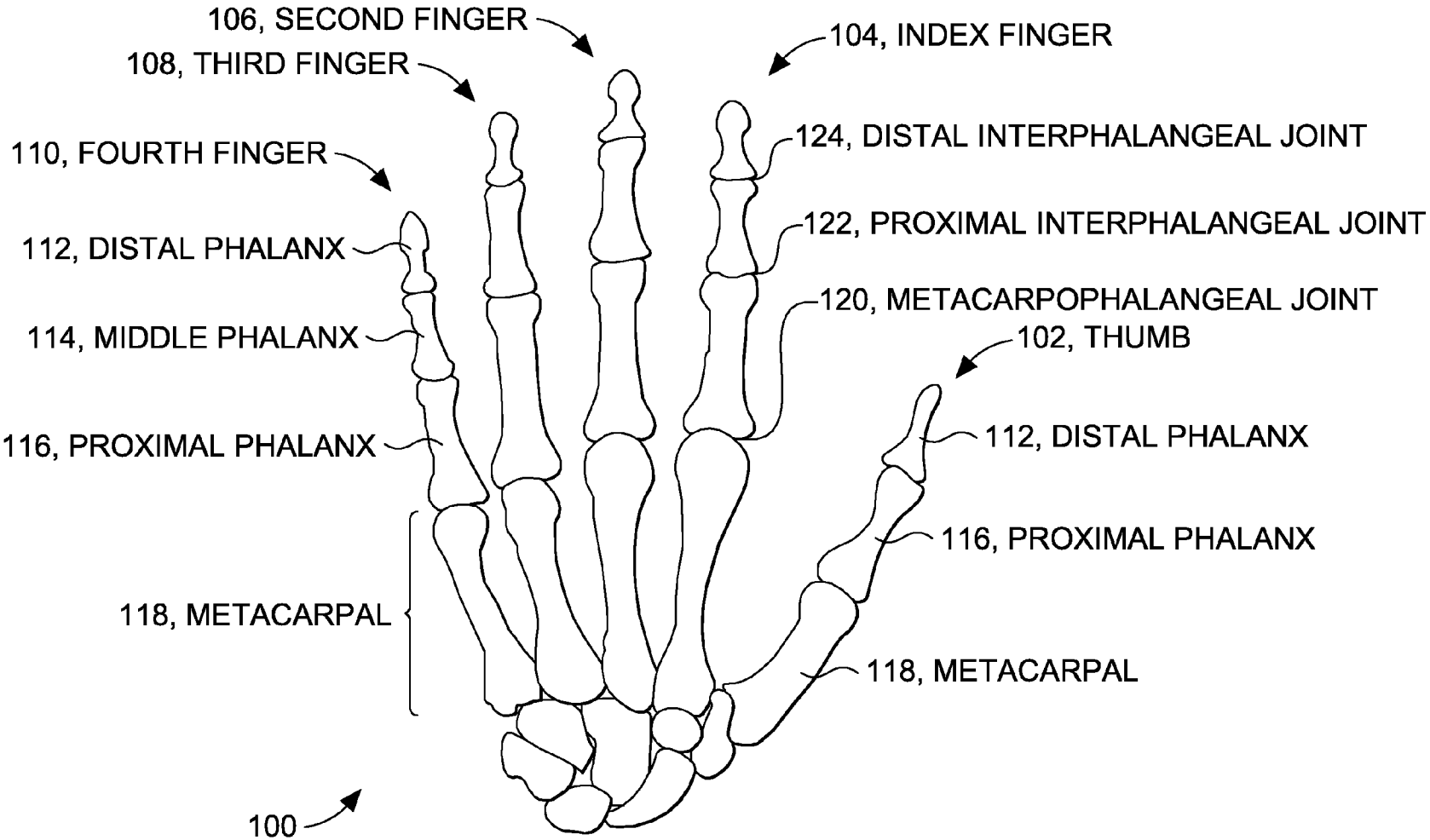
FIG. 1 depicts an exemplary anatomical structure of a hand for implementing embodiments of the present invention.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different members, portions, and/or elements similar to the ones described in this document, in conjunction with other present or future technologies.

Embodiments of the present invention relate to a glove. A first embodiment of the glove incorporates a substrate having an exterior surface and a complementary interior surface. The substrate is used in constructing a palmar portion of the glove. The glove also incorporates a first layer of material affixed to the exterior surface of the substrate. Further, the glove incorporates a second layer of material affixed to the interior surface of the substrate. Additionally, one of the first layer or the second layer of material has both a first thickness in a first location and a second thickness in a second location along a surface of the substrate.

In another aspect, the present invention provides a glove comprised of a substrate, the substrate effective for covering a palm region of a wearer of the glove. The glove also incorporates a gripping layer affixed to a first surface of the substrate, the gripping layer having a coefficient of friction greater than the substrate. Additionally, the glove incorporates an energy absorbing layer affixed to a second surface of the substrate, the energy absorbing layer located on the second surface of the substrate in at least two locations such that a thickness of the energy absorbing layer is greater at each of the two location than an immediately surrounding area of each of the two locations. A first location of the energy absorbing layer is effective for covering a metacarpophalangeal joint of the wearer and a second location of the energy absorbing layer is effective for covering a proximal interphalangeal joint of the wearer.

A third aspect of the present invention provides an athletic catching glove. The glove incorporates a substrate having an exterior surface and a complementary interior surface. The substrate is used in constructing a palmar portion of the glove. The glove also incorporates a first silicone layer affixed to the exterior surface of the substrate. Further, the glove incorporates a second silicone gel layer of material affixed to the interior surface of the substrate at a first location effective for covering a metacarpophalangeal joint of a wearer of the glove and a second location effective for covering a proximal interphalangeal joint of the wearer. The second silicone gel layer has a first thickness in the first location and a second thickness in a different location on the interior surface of the substrate. The first silicone layer has a static coefficient of friction greater than the second silicone gel layer of material.

Having briefly described an overview of embodiments of the present invention, an exemplary operating environment suitable for implementing embodiments hereof is described below.

Referring to the drawings in general, and initially to FIG. 1 in particular, an exemplary anatomical structure of a hand 100 is illustrated that may be used in accordance with embodiment of the present invention. In an exemplary embodiment, a wearer of a glove wears the glove over and around a hand having similar anatomical components as depicted as part of the hand 100.

The hand 100 includes four fingers and a thumb 102. The four fingers, starting closest to the thumb 102 include an index finger 104, a second finger 106, a third finger 108, and a fourth finger 110. The index finger 104 is also referred to herein as a digitus secundus manus. The second finger 106 is also referred to herein as the digitus medius. The third finger 108 is also referred to as digitus annularis. Additionally, the fourth finger 110 is also referred to herein as digitus minimus manus.

Each of the fingers 104-110 include a distal phalanx 112, a middle phalanx 114, a proximal phalanx 116, and a metacarpal bone 118. The middle phalanx 114 is also commonly referred to as an intermediate phalanx as a result of its location between the distal phalanx 112 and the proximal phalanx 116.

The thumb 102 includes a similar set of bones as the fingers 104-110; however, a middle phalanx 114 is not included. Consequently, the thumb 102 includes the distal phalanx 112, the proximal phalanx 116, and the metacarpal bone 118.

At an intersection or joining of bones within the fingers 104-110 and the thumb 102, a joint is defined. For example, a distal interphalangeal joint 124 is defined as the intersection of the distal phalanx 112 and the middle phalanx 114. A proximal interphalangeal joint 122 is defined at the intersection of the middle phalanx 114 and the proximal phalanx 116. Additionally, a metacarpophalangeal joint 120 is defined at the intersection of the proximal phalanx 116 and the metacarpal bones 118.

A palmar side of the hand 100 is a side that includes the palm and is in a direction that the fingers 104-110 typically curl to create a fist or grasp an object. Therefore, when discussed herein, a palmar surface of the hand 100 or of a glove that may be worn on the hand 100 is in the direction to which the fingers 104-110 are able to curl to create a fist of the hand 100.

A typical hand, such as the hand 100, has natural energy absorbing portions, sometimes referred to as "fat pads" along certain portions of the hand. These fat pads may be comprised of natural tissue (e.g., tendons, muscle, and ligament), fluids, and fat. The fat pads may be located along each of the phalanx bones (i.e., distal phalanx 112, middle phalanx 114, and proximal phalanx 116) and metacarpal bones 118 of the hand 100. However, the energy absorbing ability of the natural fat pads may diminish near joints of the fingers 104-110 and the thumb 102 as a result of a hand's traditional reduction of tissue and other biological matter near a joint to facilitate movement about the joint. For example, natural fat pads generally reduce in size on the palmar side of a hand around the metacarpophalangeal joint 120, the proximal interphalangeal joint 122, and the distal interphalangeal joint 124 to allow flexibility about each of the joints in the palmar direction.

Consequently, an embodiment of the present invention supplements the natural energy absorption provided by fat pads through use of one or more energy absorbing materials placed on a palmar portion of a glove (e.g., interior side or exterior side of the palmar portion of a glove). For example, energy absorbing material, such as a silicone gel or a foam, is discontinuously located along each of the fingers 104-110 and the thumb 102 at a location for covering at least some of the joints where natural fat pads are diminished in effectiveness for absorbing energy of an incoming object (e.g., football, soccer ball). The energy absorbing characteristics of the material is adjustable, in an exemplary embodiment, based on a thickness of the material present at a particular location. Consequently, when supplementing natural fat pads of a hand, the thickness of the energy absorbing material may be reduced in locations of a glove that typically cover natural fat pads of a hand. Additionally, the thickness of the energy absorbing material, in an embodiment, is increased in locations of the glove that typically cover areas of a hand have less energy absorptions properties from the natural fat pads (e.g., joints). Further the thickness of the energy absorbing material may also be increased in locations of the glove where additional energy absorption is necessary in addition to the natural fat pads of a hand.

An additional factor considered in an exemplary embodiment of the present invention when selecting location, size, and/or thickness of energy absorption materials affixed to a palmar portion of a glove includes tactile feedback. By the very nature of energy absorbing materials, a portion of the energy typically translated into a tactile sensation is absorbed. Consequently, athletes using gloves in training and in competition expect or need tactile feedback in order to perform. As a result, energy absorbing material may, in an exemplary embodiment, be limited in location, size, and/or thickness to maintain the ability of an athlete to "feel" an incoming object so as to properly react.

For example, an American football receiver relies on tactile sensations generated by a football as it enters the hands of the receiver. The receiver then adjusts the hand and fingers of the hand to secure the football. In order to effectively adjust the hand, a receiver "feels" the ball and manipulates finger and hand position to accommodate the direction and orientation of the ball. Therefore, in an exemplary embodiment, it is desirable for the energy absorbing material to be located and sized appropriately to absorb energy of an incoming object while still allowing the athlete to "feel" the incoming object.

As will be discussed in more detail hereinafter, an exemplary embodiment of the present invention accomplishes absorbing energy from an initial impact of a sporting object while maintaining an athlete's feel of the object by increasing the thickness of energy absorbing material near joints of the hand and reducing the thickness of the energy absorbing material proximate to natural fat pads, which naturally are adapted and capable to "feel" the object. Therefore, in an exemplary embodiment, the energy absorbing material affixed to a glove is not continuous at a common thickness across a palmar portion of the glove. Instead, the thickness, in an exemplary embodiment, is varied at particular locations to enhance energy absorption while maintaining tactile sensation for a wearer of the glove.

Figure 2:
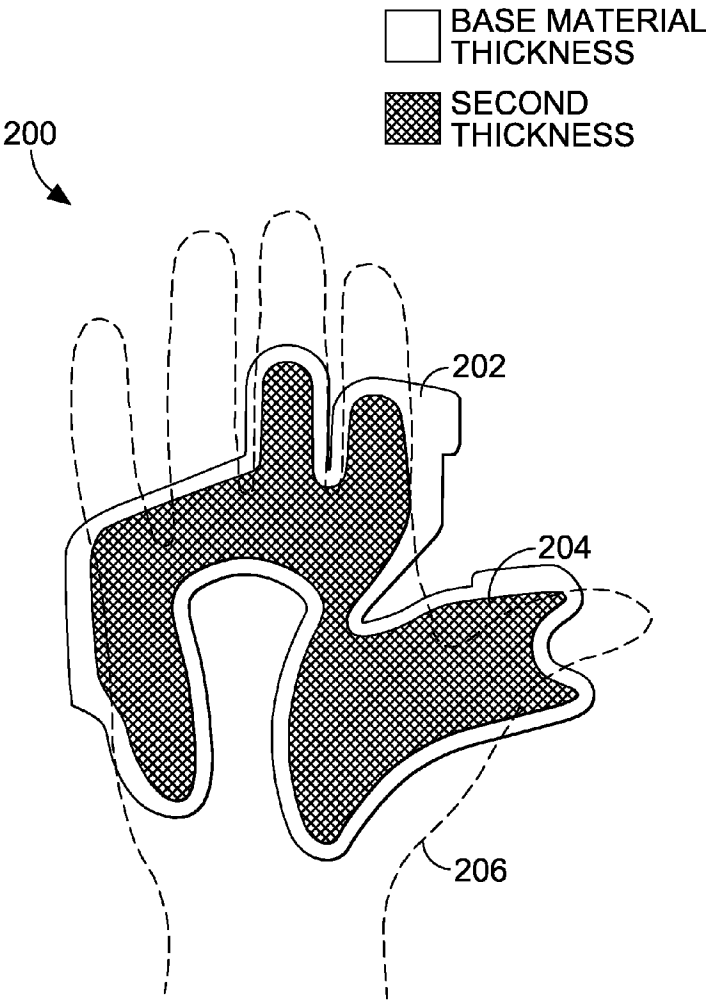
FIG. 2 depicts an exemplary energy absorbing material portion functional to be affixed to a palmar portion of a glove in accordance with embodiments of the present invention.

FIG. 2 depicts an exemplary energy absorbing material portion 200 adapted to be affixed to a palmar portion of a glove in accordance with embodiments of the present invention. In this exemplary embodiment, the portion 200 has at least two primary thicknesses, a base material thickness 202 and a second thickness 204. FIG. 2 includes an illustration of a wearer's hand 206 positioned relative to the portion 200. It is understood that the hand 206 is illustrated to provide contextual location bearings for an embodiment of the present invention. The hand 206, or any other illustrated hand herein, should not be construed as limiting as to the scope of the present invention unless explicitly stated as such.

The portion 200, in an exemplary embodiment, is a silicone gel that is cured to a substrate. The substrate may be a material that is then affixed to a portion of a glove. Or, the substrate may be a portion of the glove. In another exemplary embodiment, energy absorbing materials include ethylene vinyl acetate ("EVA"), polyurethane, silicone, and neoprene. It is contemplated that other energy absorbing materials may also be utilized and those delineated by name herein are merely exemplary in nature.

The second thickness 204 area of the portion 200 may be any thickness. In an exemplary embodiment, the second thickness 204 is about two millimeters thicker than the base material thickness 202. In an additional exemplary embodiment, the second thickness 204 is about one millimeter thicker than the base material thickness 202. The base material thickness 202 may be any thickness. In an exemplary embodiment, the base material thickness 202 is about 0.125 millimeters to about one millimeter. But, in an additional exemplary embodiment, the base material thickness 202 of the energy absorbing material ranges from one millimeter to several millimeters. Further, it is contemplated that a transition from the base material thickness 202 to the second thickness 204 areas of the energy absorbing material portion 200 exists. The transition from the second thickness 204 to the base material thickness 202 may be a rounding off of an edge, a gradual sloping, or other transitory geometrics to facilitate a functional transition from a first thickness to a second thickness.

Figure 3:
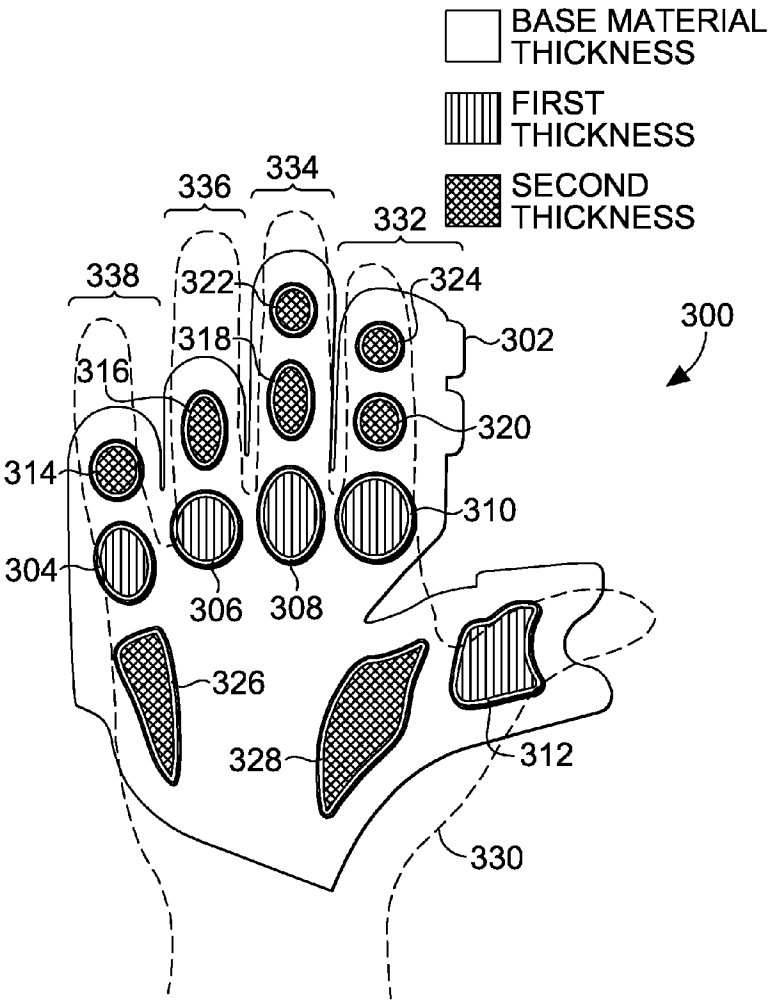
FIG. 3 depicts another exemplary palmar portion in accordance with embodiments of the present invention.

FIG. 3 illustrates another exemplary palmar portion 300 in accordance with embodiments of the present invention. The palmar portion includes a substrate 302 portion. A substrate, as previously discussed, is a material to which an energy absorbing material is affixed. For example, energy absorbing material may be a foam material cut to discrete sizes that is not a continuous thickness across a substrate. Upon affixing the foam to a substrate, the foam is maintained at particular location within the glove. In an additional exemplary embodiment, the energy absorbing material is a gel substance, such as a silicone gel. The gel substance may have an initial state that is fluid in characteristic. In this example, the gel substance may be cured, from a fluid to a semi-solid/solid substance, on a substrate. In an exemplary embodiment, a substrate is a malleable and fibrous textile or cloth that has limited elasticity in order to maintain an energy absorbing material at a particular location within the glove. In another exemplary embodiment, the substrate is a material having desirable properties for affixing a silicone thereto. Further, a substrate is also contemplated as additional substances and materials, such as the energy absorbing material itself or an inherent portion of the energy absorbing material.

The palmar portion 300 includes the substrate 302, which extends past in some areas and covers only a portion of an exemplary hand 330 in other areas. As will be discussed in more detail below when describing exemplary locations for energy absorbing material of extra thickness, the energy absorbing material may only cover a portion of the palmar side of some fingers while wrapping around a lateral side of other fingers or a thumb. Therefore, while the substrate 302 has a base material thickness that is graphically depicted as extending beyond portions of the hand 330, it is understood that when utilized in a glove, the substrate 302 may wrap around portions of the hand 330 when incorporated into the glove. Therefore, in addition to palmar portions of the hand 330 having the substrate 302, lateral portions of the hand 330 may as well.

The substrate 302, in this exemplary embodiment, is a substrate covered with a gel substance having at least a base material thickness. The gel substance, at particular locations on the substrate 302, has a greater thickness than the base material thickness. For example, a first thickness is located at a pad 304, 306, 308, 310, and 312. In this example, the pads 304-312 are of an approximate similar thickness. For example, the pads 304-312 may be about one millimeter thicker than the base material. Similarly, pads 314, 316, 318, 320, 322, 324, 326, and 328 have an approximately similar thickness illustrated as a second thickness. In an exemplary embodiment, the second thickness is about one millimeter greater than the first thickness, or about two millimeters greater than the base material thickness.

Metacarpophalangeal (MP) joints, as previously discussed, are defined as the intersection of a proximal phalanx and a metacarpal bone within a hand. An MP joint, stated differently, may be identified on a hand at the apparent intersection of a finger with a palm. Pads 304-301 are positioned on the substrate 302 so as to provide energy absorption at an MP joint of the hand 330. As previously discussed, natural energy absorption characteristics of a hand may have a reduced affect at a joint compared to areas between joints. This may be a result of smaller volume of the natural fat pads of a hand proximate to a joint. Therefore, to supplement the reduced area of natural energy absorption material, a pad, such as the pads 304-310, may be positioned in such a manner as to effectively cover the MP joints when wearing a glove.

Because the anatomical shape of a hand may change with each finger, each of the pads 304-310 may be of different dimensions even though each of the pads 304-310 is positioned to provide supplementary energy absorption at an MP joint. Further, the shape of each of the pads 304-310 may be altered to maintain a desired level of flexibility of a wearer of the glove.

Pad 312 is positioned on the substrate 302 to effectively cover a joint of a thumb defined by the intersection of a distal phalanx and a proximal phalanx of the thumb. As clearly illustrated in FIG. 3, the shape of the pad 312 is effective for covering a range of motion possible of an opposable thumb when catching a sporting object. The pad 312, in an exemplary embodiment, is the first thickness of energy absorbing material.

Pads 316-320 are positioned on the substrate 302 to effectively cover a proximal interphalangeal (PIP) joint of the hand 330. As similarly stated before, the pads 314-320 may also have various sizes and shapes to achieve a desired level of mobility and functionality at each of the PIP joints. The pads 314-320, in this exemplary embodiment, are of a second thickness.

Pads 322 and 324 are positioned on the substrate 302 to effectively cover a distal interphalangeal (DIP) joint of the hand 330. As similarly stated before, the pads 322 and 324 may also have various sizes and shapes to achieve a desired level of mobility and functionality at each of the DIP joints. The pads 322 and 324, in this exemplary embodiment, are of a second thickness.

Pads 326 and 328 are positioned on the substrate 302 at a location effective for supplementing energy absorption along a metacarpal bone of the hand 330. In an exemplary embodiment, the pad 326 is located on the substrate 302 such that when implemented in a glove, the pad 326 is positioned so as to aid in energy absorption along a metacarpal bone of a fourth finger. Similarly, in an exemplary embodiment, the pad 328 is positioned on the substrate 302 so as to effectively supplement energy absorption along a metacarpal bone of a thumb.

While FIG. 3 illustrates pads 322 and 324 as effective for covering a DIP joint at a first finger and a second finger, it is understood that an additional pad is contemplated, in an additional exemplary embodiment, as covering a DIP joint for a third finger and/or a pad for covering a DIP joint of a fourth finger. Further, it is contemplated that one or more of the pads 304-328 may be omitted while still maintaining the scope of the present invention.

While the substrate 302 includes a base material thickness of energy-absorbing material across an area of the substrate 302, a thickness of the energy absorbing material increases at each pad location. Consequently, the thickness of the energy absorbing material is greater at each of the pads than the immediate surrounding area of each of the pads. This variation in thickness of the energy absorbing material is described as a discontinuous thickness of energy absorbing material. In an additional embodiment that will be discussed in greater detail with respect to FIG. 4, a discontinuous thickness of energy absorbing material also occurs when each of the pads is a discrete portion of energy absorbing mater, such as individual foam pads. Because the energy absorbing materials discussed in this example are individual pads, a base thickness may not be present between the individual pads. Instead, another material, such as the substrate, may be present in the area separating the energy absorbing material. Regardless, in this example, there is a discontinuous thickness of energy absorbing material as will be shown and discussed in greater detail in FIGS. 6-8.

Returning to FIG. 3, a width of the substrate 302 proximate to various fingers is demonstrated by widths 332-338. For example, the width 332 identifies a dimensional width that is perpendicular to a proximal-distal axis of a first finger portion of the substrate 302. Similarly, the width 334 identifies a dimensional width that is perpendicular to a proximal-distal axis of a second finger portion of the substrate 302. Similarly, the width 336 identifies a dimensional width that is perpendicular to a proximal-distal axis of a third finger portion of the substrate 302. Similarly, the width 338 identifies a dimensional width that is perpendicular to a proximal-distal axis of a fourth finger portion of the substrate 302.

In an exemplary embodiment, the width 332 is greater than the widths 334-338. The greater width 332 facilitates "wrapping" or extending energy absorbing material along a lateral side of the first finger. In another exemplary embodiment, the substrate 302 includes a gripping material on a first side and an energy absorbing material on a complementary parallel side. In an effort to increase the surface area or contact area for the gripping material to make contact with a sporting object on an exterior side of the substrate 302, the substrate 302 is wrapped along a thumb-side-lateral portion of a first finger. Because a sporting object may make contact with this thumb-side-lateral portion of a first finger, supplemental energy absorption is desired in an exemplary embodiment. Consequently, wrapping a substrate having a gripping material on an exterior surface and an energy absorbing material on a second surface around one or more finger portions of a glove facilitates a wearer of the glove in effectively catching and maintain a sporting object. It is contemplate that similar wrapping techniques are employed about a thumb portion of a glove in an exemplary embodiment.

Figure 4:
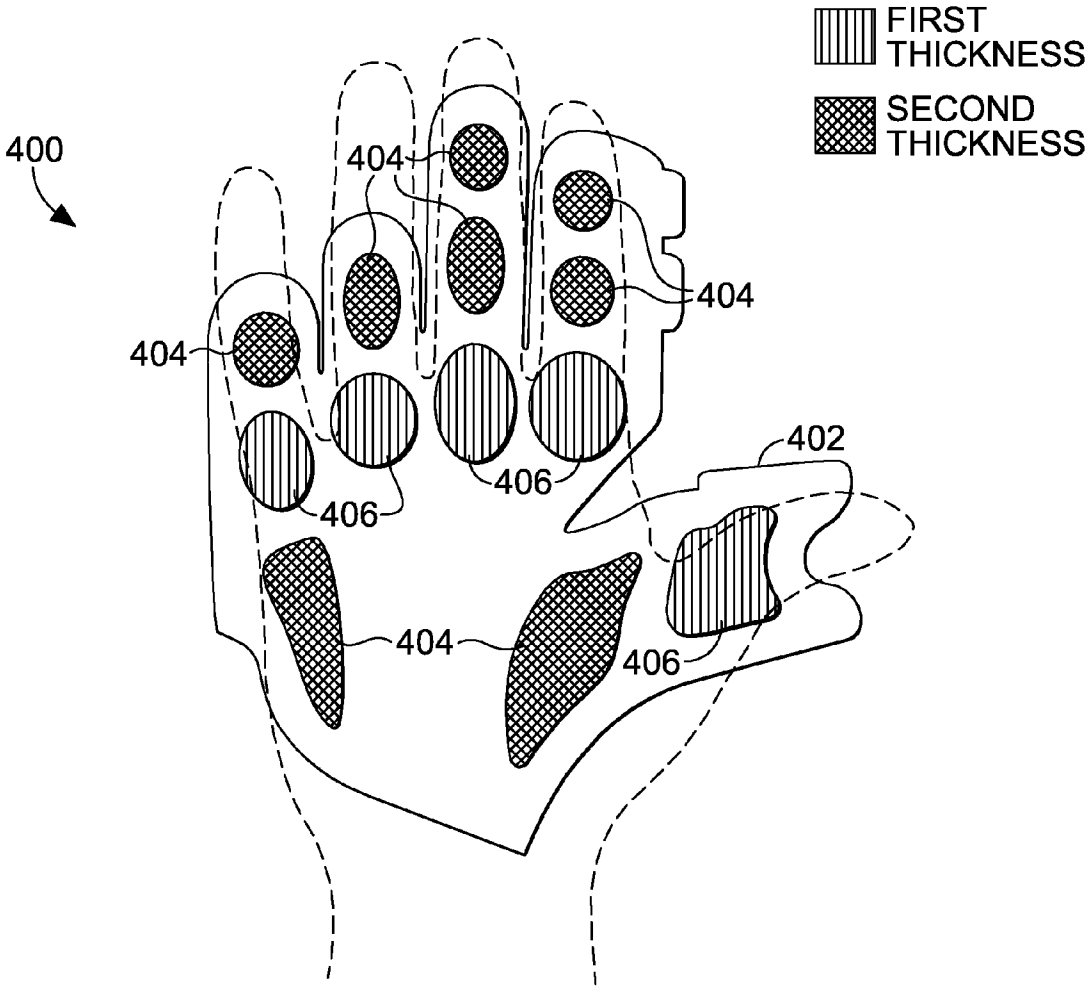
FIG. 4 depicts a substrate having discrete energy absorbing pads affixed thereto in accordance with embodiments of the present invention.

Turning to FIG. 4 that depicts a substrate 402 having discrete energy absorbing pads affixed thereto in accordance with embodiments of the present invention. Discrete energy absorbing pads are constructed from an energy absorbing material, such as those previously discussed. In an exemplary embodiment, the energy absorbing pads are individual units of foam material affixed to the substrate 402.

Unlike FIG. 3, which depicts a base layer of energy absorbing material dispersed between each of the individual pads, FIG. 4 has discrete energy absorbing pads affixed directly to the substrate. A first group of pads 406 are of a first thickness. A second group of pads 404 are of a second thickness. For example, the pads 406 may be formed from a common sheet of material. The pads 404 may be formed from a similar sheet of material that varies only in thickness (i.e., thicker or thinner). In an additional exemplary embodiment, one or more different materials may be used for individual pads or sets of pads.

In an exemplary embodiment, the substrate 402 has portions, such as a first finger portion and a thumb portion that, when formed with a glove, wrap around a part of a corresponding finger or thumb of a wearer. However, unlike FIG. 3 that depicts a base layer of energy absorbing material extending beyond the individual pads, the substrate 402, in this embodiment, does not include a base layer of energy absorbing material beyond the pads 404 and 406. However, the wrapping effect of the substrate 402 is desirable, in an embodiment, to facilitate extending a gripping material, adhered to the substrate surface, along a lateral surface of a finger or thumb portion of the glove.

Figure 5:
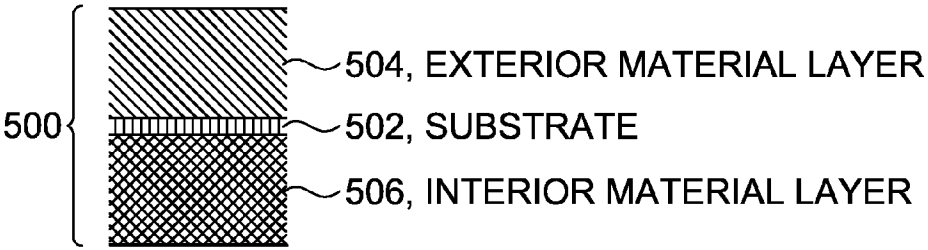
FIG. 5 depicts a section view of a layering of materials in accordance with embodiment of the present invention.

Turning to FIG. 5 that depicts a layering of materials 500 in accordance with embodiment of the present invention. The layering of material 500 includes a substrate 502, an exterior material layer 504, and an interior material layer 506.

The substrate 502, as discussed previously, may include any material functional for having one or more layers affixed thereto. For example, a flexible material suitable for use in a palmar region of an athletic glove is an exemplary substrate 502.

The exterior material layer 504 is a material affixed to the substrate 502 on an exterior surface of the substrate 502. Traditionally, an exterior surface of the substrate 502 is a surface facing an exterior portion of a glove. This is in contrast to an interior surface of the substrate 502, which is a surface typically facing the interior or hand-receiving cavity of a glove. In an additional exemplary embodiment, the substrate 502, while not illustrated in FIG. 5 as such, is a plurality of material layer affixed to one another. For example, a first substrate layer may have an exterior gripping material affixed thereto and a second substrate layer may have an energy absorbing material affixed thereto.

Therefore, the substrate 502, in this example, is the combination of the first and the second substrate layers discussed above.

The exterior material layer 504, in an exemplary embodiment, is a silicone material having a coefficient of friction greater than the underling substrate 502, but equal to or less than a coefficient of friction threshold limit established by a governing body. For example, the National Operating Committee on Standards for Athletic Equipment requires a static coefficient of friction that is 2.0 or less when tested according to their outlined test procedures. Consequently, in this example, the exterior material layer has a coefficient of friction that is 2.0 or less. In an exemplary embodiment, a static coefficient of friction is measured relative to a pattern #62 glass that is at least 50% wider than the test material sample (e.g., exterior layer material). In this example, the material sample is pulled across a pebbled surface of the pattern #62 glass at a rate of 50±2 millimeters/minute with approximately 210 grams of weight bearing down on the material sample. It is understood that additional testing procedures, deviations, variable, and constants may be used when measuring a static coefficient of friction.

The exterior material layer 504, in an exemplary embodiment, is a layer of silicone material that is applied to the substrate 502 in a liquid/semi-liquid form. After curing, by time, heat, chemical reaction, or the like, the silicone cures as a flexible material affixed to the underlying substrate 502. Additional methods of affixing the exterior material layer 504 to the substrate 502 include adhesives, bonding agents, mechanical fasteners, stitching, and the like. Consequently, the exterior material layer 504 may be affixed to the substrate 502 in either a permanent, semi-permanent, or temporary manner.

In additional exemplary embodiments, the exterior material layer 504, which is an exterior gripping material, may be any material having a greater coefficient of friction than an underlying substrate. For example, the exterior material is contemplated as at least one, or a combination of, silicone, polyurethane, thermoplastics polyurethanes (TPU), rubber (synthetic and/or natural) leather, goat skin, polyvinyl chloride (PVC), acrylic, thermo plastic elastomers (TPE), and/or the like. Therefore, in an exemplary embodiment, a combination of one or more materials is utilized to form the exterior material layer. For example, portions of the exterior material layer may be comprised of a silicone and a goat skin to provide desired characteristics at particular locations of a glove. It is contemplated that any combination of listed or similar material may be utilized to form at least a portion of the exterior material layer.

The interior material layer 506 is a layer of material affixed to an interior surface of the substrate 502. In an exemplary embodiment, the interior material layer 506 is a layer of silicone gel material that is effective for absorbing kinetic energy of an object impacting the material. In an additional and/or complimentary embodiment, the interior material layer 506 is a foam material that is also effective for absorbing kinetic energy of an impacting object with the material.

While not illustrated herein, it is understood that additional material layers may be implemented with embodiments of the present invention. For example, a lining material may be affixed, partially or completely, to a surface of the interior material layer 506. In this example, to facilitate easier application or removal of a glove, a lining material may be employed to ease the movement of the glove over and about a wearer's hand.

In an exemplary embodiment, the exterior material layer 504 is a silicone material and the interior material layer 506 is also a silicone material, but a different silicone material. In this example, the exterior material layer 504 is selected because of grippiness or tackiness characteristics of the material to aid in the catching and maintaining of a sporting object (e.g., ball). Consequently, a higher coefficient of friction between the material and the object to be received is desired. Alternatively, the interior material layer 506 is a layer of silicone gel material selected for its energy absorption characteristics. Therefore, a lower coefficient of friction for the interior material layer 506 than the exterior material layer 504 is desired. Stated differently, the exterior material layer 504, in an exemplary embodiment, has a greater coefficient of friction than the interior material layer 506. In an embodiment, the lower coefficient of friction for the interior material layer 506 is selected as a characteristic to facilitate applying and/or removing a glove from a hand.

In an exemplary embodiment, the interior material layer 506 is a foam or gel material effective for absorbing a compressive energy. For example, firmness levels at varied compressive deflective forces may be measured for a particular energy absorbing material to ensure a proper a desired amount of energy absorption is available from the material. Energy absorbing material may be measured as a factor of toughness, compression, shock mitigating properties, or the like. Further, an acceptable energy absorbing material me exhibit a positive relationship on a stress and strain curve. For example, foam based energy absorbing material traditionally has a great energy absorbing characteristic as density of the foam increases. However, as a result of the previously discussed desire for tactile feedback, a balancing of properties at various location of an athlete's hand may occur. Consequently, energy absorption characteristics may be quantified using several measures depending on the material, but regardless of the material, energy absorbing characteristics are balanced with usability and practicability characteristics.

Figure 6:
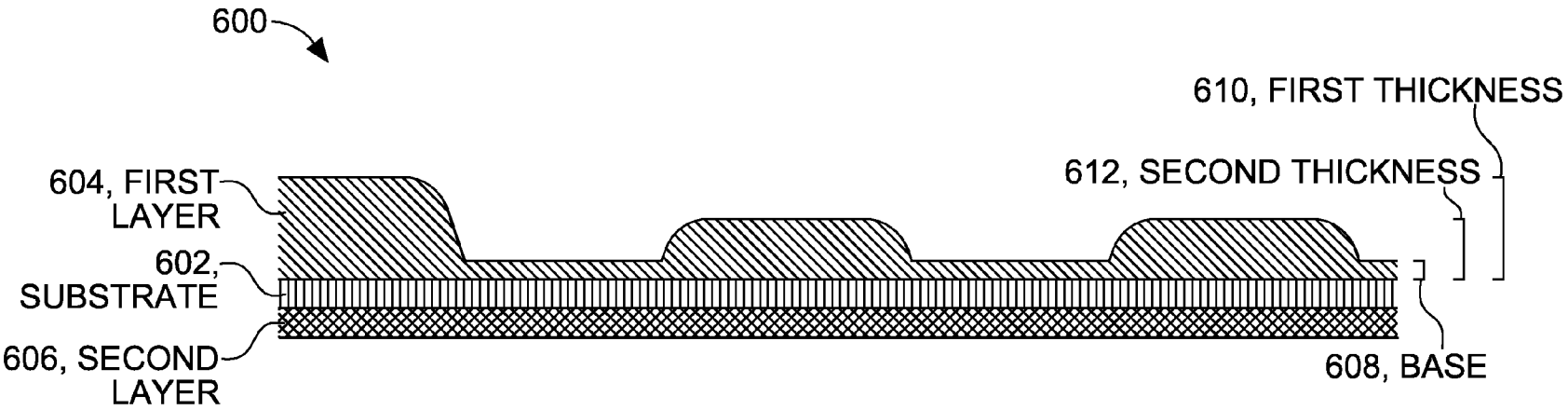
FIG. 6 depicts another section view of a layering of materials in accordance with embodiment of the present invention.

Turning to FIG. 6 that depicts a layering of materials 600 in accordance with an exemplary embodiment. FIG. 6 is a section view (not to scale) along a proximal-distal axis of a second finger portion of a palmar section illustrated in FIG. 3. The layering of material 600 includes a substrate 602, a first layer 604, and a second layer 606.

The first layer 604 is an exemplary layer of gel-like material forming an energy absorbing layer, in accordance with embodiments of the present invention. The first layer has a discontinuous or non-uniform thickness of energy absorbing material. As illustrated, the first layer 604 includes a plurality of thicknesses such as a base 608 thickness, a first thickness 610, and a second thickness 612. Because an area of first thickness 610 or second thickness 612 is separated from another area of first thickness 610 or an area of second thickness 612, there is a discontinuous thickness of the material. Stated differently, each area of first thickness 610 or second thickness 612 is greater than the immediate surrounding area thickness (i.e., base 608). The immediate surrounding area may be defined to extend less than a millimeter to several millimeters from the pad. For example, an immediate surrounding area may range from one to five millimeters.

The base 608 may have a thickness ranging from a few tenths of a millimeter to a couple millimeters. In an exemplary embodiment, the base 608 is 0.1275 to 0.75 millimeters thick. In an exemplary embodiment, the first thickness 610 is a thickness of base 608 plus one millimeter, also referred to herein as one millimeter thick as it is relative to a constant plane defined by a base layer. In an exemplary embodiment, the second thickness 612 has a thickness of base plus two millimeters, also referred to herein as two millimeter thick for the reasons discussed above. In an exemplary embodiment, the greater a thickness of energy absorbing material, the greater the capacity of the energy absorbing material to absorb impact energy. Consequently, in an exemplary embodiment, the absorption of impact energy provides an athlete more time to react to an object in order to maintain control and even catch the object.

As illustrated by the section view provided by FIG. 6, a rounding or graduation from a first thickness 610 or a second thickness 612 to a base 608 may be employed for manufacturing purposes and/or wearer comfort.

Figure 7:
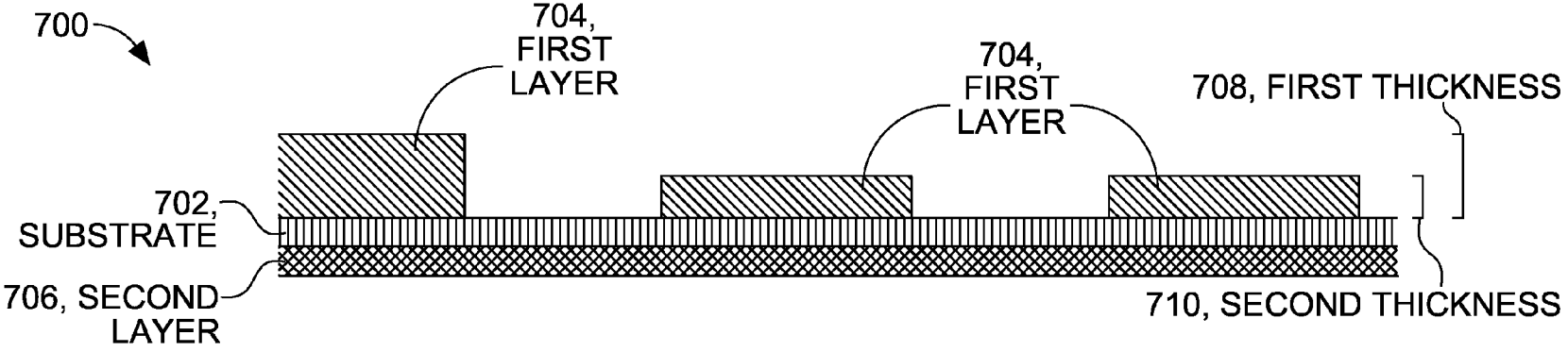
FIG. 7 depicts a third section view of a layering of materials in accordance with embodiment of the present invention.

Turning to FIG. 7 that depicts another material layer 700 in accordance with embodiments of the present invention. FIG. 7 is a section view (not to scale) along a proximal-distal axis of a second finger portion of a palmar section illustrated in FIG. 4. The material layer 700 includes a substrate 702, a first layer 704, and a second layer 706. Additionally, a second thickness 708 and a second thickness 710 are illustrated.

In an exemplary embodiment of the present invention, the first layer 704 is a foam material. The first layer 704 is the first thickness 708 at one or more locations along the substrate 702. The first layer 704 is the second thickness 710 at one or more locations on the substrate 702. The first layer 704 is another example of a layer having a discontinuous thickness. For example, areas immediately surrounding the first layer 704 having the second thickness 710 have a smaller (i.e., no measurable thickness of the first later 704) thickness than the second thickness 710.

While portions of the first layer 704 are illustrated as having right angles when transitioning from a first thickness 708 or a second thickness 710, it is contemplated (not shown) that a gradual transition or rounding effect is implemented for at least those reasons previously discussed.

Figure 8:
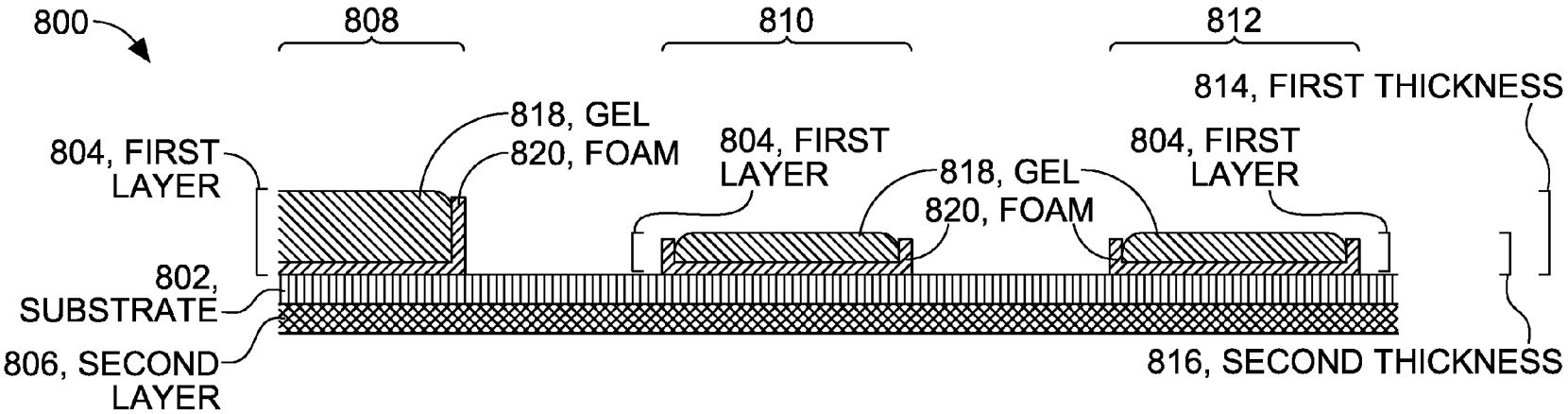
FIG. 8 depicts a fourth section view of a layering of materials in accordance with embodiment of the present invention.

FIG. 8 depicts another material layer 800 (not to scale) in accordance with embodiments of the present invention. FIG. 8 is a section view (not to scale) along a proximal-distal axis of a second finger portion of a palmar of an exemplary glove. The material layer 800 includes a substrate 802, a first layer 804, and a second layer 806. The first layer 804 is comprised of both a gel 818 material and a foam 820 material.

Each of the pads 808, 810, and 812 provide energy absorption supplementation to the natural fat pads or materials of a wearer's hand. A hybrid first layer 804 that includes both gel 818 and foam 820, in an exemplary embodiment, provides advantages for comfort, manufacturing, and energy absorption. For example, a foam 820 cradle may be affixed to the substrate 802 for receiving, placing, and maintaining a gel 818 insert. As a result, a less expensive foam material, in an exemplary embodiment, is utilized to provide a level of energy absorption, which is then further supplemented at specific location with a more costly gel 818 insert. In this example, a base layer of gel is not used to maintain relative spacing of gel pads. The gel 818 may be a silicone gel previously discussed.

In an exemplary embodiment of the present invention, the foam 820 is affixed to the substrate 802 and the gel 818 is then affixed to the foam 820, as illustrated in FIG. 8. In an additional embodiment, the foam 820 is affixed to the substrate 802 and the gel 818 is also affixed to the substrate 802 (not shown) as a result of a void/hole in the foam 820 that allows the gel 818 to contact the substrate 802.

The first layer 804 is a first thickness 814 in one or more locations and the first layer 804 is a second thickness 816 in one or more locations. For example, the pad 808 is the first thickness 814 and the pads 810 and 812 are the second thickness 816 in this example. As previously discussed, thickness of a pad may be adjusted to achieve a desired level of energy absorption and/or flexibility. Thickness of a pad may be altered by changing an amount of foam 820, gel 818, or a combination of the two that comprise the pad.

Figure 9:
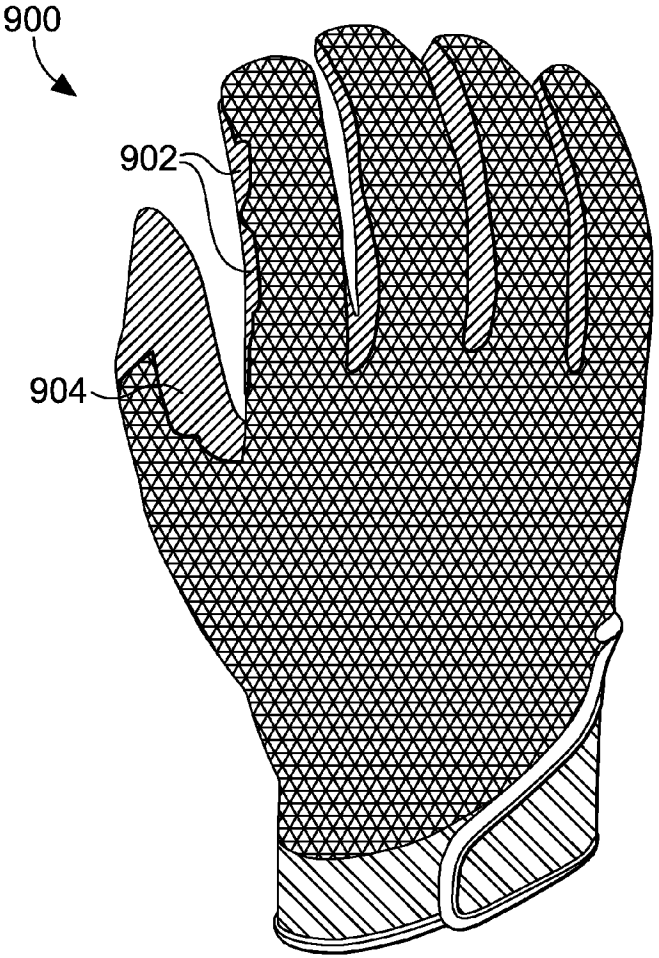
FIG. 9 depicts a dorsal view of a glove in accordance with an embodiment of the present invention.

Turning to FIG. 9 that depicts a dorsal view of a glove 900 in accordance with an embodiment of the present invention. The glove 900 is constructed of a number of elements, including a substrate 902 wrapping around a first finger portion of the glove 900. In an exemplary embodiment of the present invention, the substrate 902 portion has affixed thereto a gripping material, such as a silicone material cured to the substrate for increasing a coefficient of friction relative to the substrate material. An additional portion 904 of the substrate is illustrated as wrapping around a thumb portion of the glove 900. In both the substrate 902 and the portion 904 examples, the substrate material extends beyond the palmar portion to include, at least partially, a lateral portion of a finger and/or a thumb section.

Figure 10:
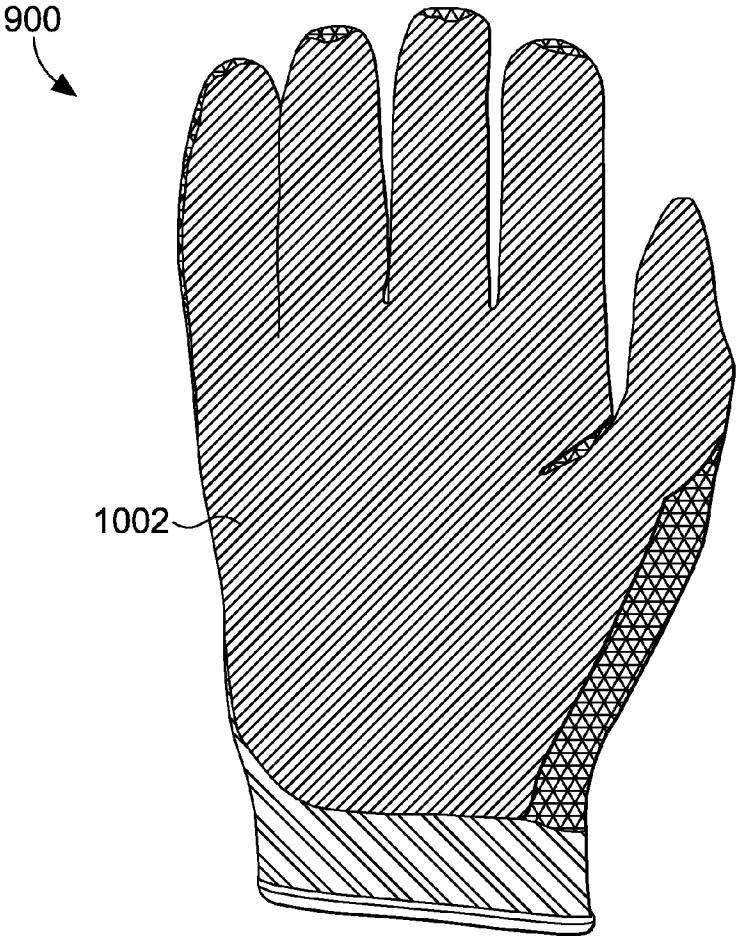
FIG. 10 depicts a palmar view of a glove in accordance with embodiments of the present invention.

Turning to FIG. 10 that depicts a palmar view of the glove 900 in accordance with an embodiment of the present invention. The palmar portion of the glove 900 includes a substrate 1002. The substrate 1002, in an exemplary embodiment has a gripping material adhered to an exterior portion, the gripping material has a greater coefficient of friction than the underlying substrate to which the gripping material may be affixed. Therefore, in an exemplary embodiment, a substrate having a gripping material affixed to an exterior surface is located on at least a palmar portion of the glove 900 as well as other location of the glove 900 to which an object (e.g., ball) may make contact when the glove 900 is worn.

Many different arrangements of the various materials, layers, and/or pads depicted, as well as items not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features are of utility and may be employed without reference to other features and are contemplated within the scope of the claims.

The invention claimed is:

1. A glove comprising:

a substrate having a first surface and an opposite second surface, wherein the substrate is used in constructing a palmar portion of the glove;

a first grip layer of material affixed to the first surface of the substrate;

a first tactile feedback layer of material having a first thickness affixed to the second surface of the substrate at a first location on the substrate; and a second tactile feedback layer of material having a second thickness different from the first thickness affixed to the second surface of the substrate at a second location on the substrate, wherein the second location is different from the first location.

2. The glove of claim 1, wherein the palmar portion of the glove is configured to cover a palm of a wearer when the glove is worn by the wearer.

3. The glove of claim 2, wherein the first grip layer of material is a layer of silicone.

4. The glove of claim 3, wherein the first grip layer of material is affixed to the first surface of the substrate by curing a fluid silicone to the first surface of the substrate.

5. The glove of claim 3, wherein the first grip layer of material has a greater static coefficient of friction than the first tactile feedback layer of material.

6. The glove of claim 1, wherein the first tactile feedback layer of material is a layer of silicone gel.

7. The glove of claim 1, wherein the first tactile feedback layer of material is a layer of resilient foam.

8. The glove of claim 7, wherein the first tactile feedback layer of material is affixed to the second surface of the substrate using an adhesive.

9. The glove of claim 1, wherein the first tactile feedback layer of material is selected from the following:

(1) Ethylene vinyl acetate (EVA),
(2) Polyurethane,
(3) Silicone, or
(4) Neoprene.

10. A glove comprising:

a substrate comprising a first surface and a second surface, the substrate covering at least a palmar portion of the glove;

a gripping layer affixed to the first surface of the substrate;

a first energy absorbing layer, having a first thickness, affixed to the second surface of the substrate at a first location configured to align with at least one metacarpophalangeal joint of the wearer when the glove is worn; and a second energy absorbing layer, having a second thickness, affixed to the second surface of the substrate at a second location configured to align with at least one proximal interphalangeal joint of the wearer when the glove is worn.

11. The glove of claim 10, wherein the first energy absorbing layer affixed to the second surface comprises a first thickness and the second energy absorbing layer comprises a second thickness.

12. The glove of claim 11, wherein the first thickness is about 1 millimeter thicker than the second thickness.

13. The glove of claim 11, wherein the substrate comprises a base thickness, wherein the first thickness of the first energy absorbing layer is 2 millimeters greater than the base thickness, and the second thickness of the second energy absorbing layer is 1 millimeter greater than the base thickness.

14. The glove of claim 10, wherein the first surface of the substrate corresponds to an exterior surface of the substrate, and the second surface of the substrate corresponds to an interior surface of the substrate.

15. The glove of claim 10, wherein the gripping layer is affixed to the exterior surface of the substrate by curing a fluid silicone to the exterior surface of the substrate.

16. The glove of claim 10, wherein at least the first energy absorbing layer comprises:

(1) Ethylene vinyl acetate (EVA),
(2) Polyurethane,
(3) Silicone, or
(4) Neoprene.

17. An athletic catching glove comprising:

a substrate having a first surface and a second opposite surface;

a first silicone layer affixed to the first surface of the substrate;

a second silicone layer affixed to the second surface of the substrate at a first location wherein the second silicone layer comprises a first thickness at the first location; and a third silicone layer affixed to the second surface of the substrate at a second location different from the first location, wherein the third silicone layer comprises a second thickness at the second location.

18. The glove of claim 17, wherein the second silicone layer is a metacarpophalangeal pad configured to align with at least one metacarpophalangeal joint of a wearer when the glove is worn.

19. The glove of claim 17, wherein the third silicone layer is an interphalangeal pad configured to align with at least one interphalangeal joint of a wearer when the glove is worn.

20. The glove of claim 17, wherein the first silicone layer has a greater static coefficient of friction than the second silicone layer.

* * * * *